United States Patent [19]

Grüner et al.

[11] 4,395,148

[45] Jul. 26, 1983

[54] POSITIONING OF A MULTICOLOR RIBBON

[75] Inventors: Manfred Grüner, Ulm; Wolfgang Hendrischk, Neu-Ulm, both of Fed. Rep. of Germany

[73] Assignee: Mannesmann Aktiengesellschaft, Dusseldorf, Fed. Rep. of Germany

[21] Appl. No.: 253,874

[22] Filed: Apr. 13, 1981

[30] Foreign Application Priority Data

Apr. 15, 1980 [DE] Fed. Rep. of Germany ..... 3014820

[51] Int. Cl.[3] ..... B41J 35/14

[52] U.S. Cl. ..... 400/212; 400/216.1; 400/240.4

[58] Field of Search ..... 400/212, 216.1, 216.2, 400/240.4, 155, 208

U.S. PATENT DOCUMENTS

| | | | |
|---|---|---|---|
| 3841459 | 10/74 | Buschmann et al. | 400/261.1 X |
| 3952853 | 4/76 | Feldman | 400/155 X |
| 3977320 | 8/76 | Lupkas | 400/155 X |
| 4280767 | 7/81 | Heath | 400/240.4 X |

[56] References Cited

FOREIGN PATENT DOCUMENTS

| | | | |
|---|---|---|---|
| 2337626 | 4/1974 | Fed. Rep. of Germany | 400/216.1 |
| 2512337 | 10/1976 | Fed. Rep. of Germany | 400/212 |
| 2515899 | 10/1976 | Fed. Rep. of Germany | 400/208 |
| 2306083 | 10/1976 | France | 400/212 |
| 2306836 | 11/1976 | France | 400/216.1 |

*Primary Examiner*—Clifford D. Crowder
*Attorney, Agent, or Firm*—Ralf H. Siegemund

[57] ABSTRACT

A pivoted ink ribbon guide in front of a matrix print head is positioned by a lever linkage which translates the four different combinations of energization stages of two solenoids into four different alignment positions for a multi-colored ink ribbon.

5 Claims, 4 Drawing Figures

POSITIONING OF A MULTICOLOR RIBBON

BACKGROUND OF THE INVENTION

The present invention relates to adjustments of a multicolored ink ribbon in a printer, e.g., a matrix printer.

An adjustment device of the type to which the invention pertains includes, for example, a ribbon guide which is mounted on the print head or its carriage and permits up or down displacement, e.g., by means of electromagnets, such as a solenoid, being linked to the guide through a suitable linkage. For example, when the magnet is energized, the linkage lifts the guide so that the red ribbon portion faces the print head. When the magnet is de-energized, the linkage drops the guide either by its weight or by a spring so that the black ribbon portion faces the head.

DESCRIPTION OF THE INVENTION

It is an object of the present invention to provide a new and improved ribbon guide and placement system for printers which will permit the use of more than two colors in an ink ribbon.

In accordance with the preferred embodiment of the present invention, it is suggested to provide two (or more) electromagnets, such as solenoids, which operate plungers. The four different combinations of energization and de-energization of these two solenoids establish four different stages of plunger protraction and retraction. By means of a lever linkage coupled to the plungers, these four states are used in order to establish four different displacement positions. Through further linkage and lever means, these four different positions are translated into four different lift positions of the ink ribbon guide. The system can be used, of course, for two-color and three-color ribbons, just by using less than the four different combinations of states of solenoid energization.

The ink ribbon guide is preferably pivoted on the print head, and the four different displacement positions are established by four different pivot positions. Rods and lever means transmit the latter to the guide as pivot positions thereof. The transmission includes, preferably, a spring-biased rod, attaining its position as against the weight of the ribbon guide. Any changes from any position is obtained here by changing the combination of states of energization of the solenoids. Adding another solenoid permits extension of the principle to accommodate up to eight different ink tracks.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings, FIG. 1 shows a print head 1 for a matrix printer; the printer is otherwise of conventional design and is mounted on a carriage for traveling in a direction transversely to the plane of the drawing of FIG. 1. An ink ribbon guide 2 is mounted to the head 1; and in particular, this guide is mounted for pivoting on a pin axis 4 in cantilever fashion . This guide 2 holds the ink ribbon 20, which extends also transversely to the plane of the drawing. Reference numeral 3 denotes the center axis and direction of printing and intersects the paper (not shown) in what will become the center of a line to be printed.

Figure 3:
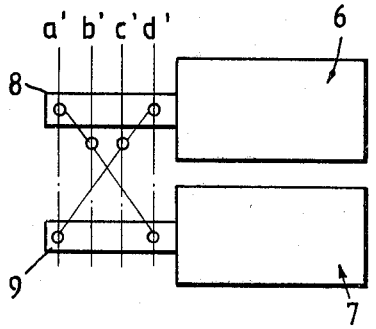
FIG. 3 is a schematic illustration of the four positions attainable in and with the structure of FIG. 1.
Figure 1:
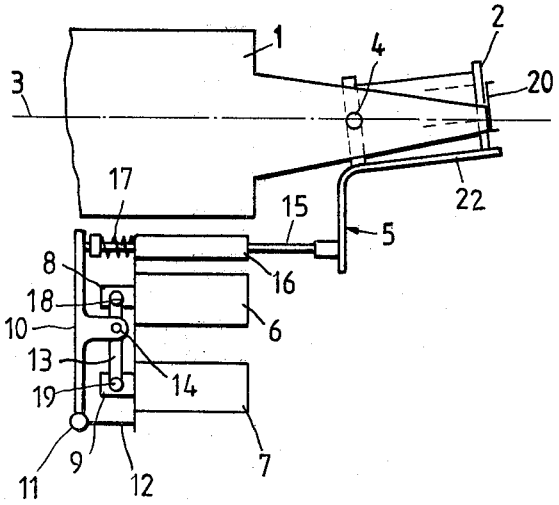
FIG. 1 is a side elevation of a print head with ribbon guide and position adjustment in accordance with the preferred embodiment of the present invention for practicing the best mode thereof.

The guide 2 is connected (secured) to one arm of an L-shaped lever 22. The other arm 5 of that lever is part of a lever and linkage system which includes other elements and is, ultimately, actuated by two electromagnets, such as solenoids 6 and 7.

The electromagnets and solenoids 6 and 7 have respectively plungers 8 and 9 which are interlinked by an arm 13; the arm is pivoted on each plunger. A coupling member and actuating lever 10 is additionally pivotally linked to arm 13, but not in the center between the connection to the plungers 8 and 9. Member 10 is of a flat T-shaped configuration, the stem being connected to pivot 14. One end of the cross bar of the T is pivoted to a point 11 to, thereby, become a one-arm lever. Lever 10 and arm 13 constitute a first lever means. As seen from lever linkage 5, pivot axis 11 is located beyond the farthest one of the magnets, which is solenoid 7. Reference numeral 12 denotes generally a stationary support structure on the carriage (or the carriage itself), on which the head 1 is mounted.

In order to connect lever system 5 to T-shaped lever 10, a tie rod 15 is provided, being guided in a stationary sleeve 16 and being biased by means of a spring 17. One end of rod 15 bears against the arm 5 of L-shaped lever 22, while the other end of rod 15 bears against the T-shaped lever 10 at a point between the pivot point 11 and the free end thereof but near the free end. Lever 22 and spring biased rod 15 constitute a second lever means. As will be explained more fully below, the free arm of T-shaped lever 10 establishes four different displacement positions, depending upon the current combination of the states of energization and de-energization of the two solenoids 6 and 7; there are four such combinations. The rod 15 establishes consequently four different positions by means of which the four different pivot states of lever 10 are translated into four different pivot states of ribbon guide 2.

It can readily be seen that the weight of the cantilevered ribbon guide 2 causes lever 22 to develop a clockwise movement that causes the free lever arm 5 to bear against rod 15. The spring 17, on the other end, causes the rod 15 to bear against lever 10, whose position is other wise restrained and defined by the solenoidal plungers 8 and 9!

Figure 2:
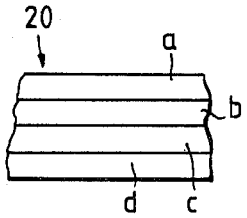
FIG. 2 is a plan view of a portion of a four-colored ink ribbon used in the device of FIG. 1.

The ribbon 20 may have four color and ink tracks a, b, c, and d (FIG. 2). In order to position any of these tracks centrally on axis 3, magnets 6 and 7 must provide particular positions of the plungers 8 and 9. The four different positions are denoted by a', b', c', and d' (FIG. 3). In order to establish a', both plungers 8 and 9 are fully extended; both solenoids are energized. That means that lever 10 is pivoted counterclockwise into the farthest position attainable in this linked system. Rod 15, therefore, is in a left-most position which is translated into the lowest position of guide 2. Upper ink track "a" will thus be on axis 3.

In order to align the axis 3 with track "b," plunger 9 is fully retracted (e.g., by de-energizing magnet 7) so that it is actually in the d'-position. But plunger 8 remains extended. Hence, the linkage point 14, being closer to plunger 8 than to plunger 9, is a little retracted, but not by half of the displacement range of each plunger. This then will result in a limited push of and by rod 15 to the right, causing the guide 2 to be pivoted up a little so that track "b" is aligned with axis 3.

The third ink track "c" is aligned with axis 3 as follows: Plunger 8 is fully retracted (to the d'-position), but plunger 9 is fully extended placing point 14 so that the systems 15, 5, etc., position ink track "c" as desired. The last position is obtained by de-energizing both magnets 6 and 7, both plungers 8 and 9 are retracted to the d'-position, and rod 15 is in its right-most position (illustrated) so that guide 2 is fully pivoted up as wanted.

Figure 4:
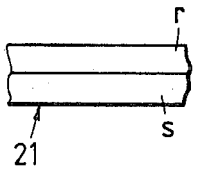
FIG. 4 is a view similar to FIG. 2 but showing a two-colored ink ribbon.

A simple two-color ribbon 21 with red and black tracks "r" and "s" (FIG. 4) can readily be used; one will only need here the two different, appropriate plunger positions, such as a', b', or b', c', or c', d', or other combinations, depending upon the size of the ribbon, positions c', d' being the most likely ones.

For practical purposes, it is desirable to design the four-color ribbon so that the outer ink tracks, "a" and "d", are used less frequently than the two other ones. The switching from one position to another is delayed to some extent by the inertia of guide 2, but if most of the switchover occurs only between two adjacent tracks, all displacement paths are, except for the plungers themselves, limited. Any of the two adjacent ink tracks will meet these considerations; minimization of the average displacement path as regards the other tracks leads directly to employment of the two inner ones (b and c) as the most frequently used ones (e.g., black and red).

Of course, the other two tracks will be used occasionally. It was found that a certain shaking of the head actually facilitates the switchover. This shaking can be obtained by twice reversing, quickly, the drive for the print head carriage, particularly when switching to the less frequently used tracks. There will always be certain delays, but that can be tolerated, in particular for the less frequently used colors.

It should be noted that the invention can be applied to ink ribbons with more than four color tracks. One additional magnet will permit eight different positions of the ribbon guide.

The invention is not limited to the embodiments described above; but all changes and modifications thereof, not constituting departures from the spirit and scope of the invention, are intended to be included.

We claim:

1. In a printer having a movable carriage with a print head mounted thereon, an arrangement for obtaining different color printings, there being an ink ribbon having a plurality of ink tracks, comprising:

a ribbon guide displaceably mounted on the head for holding the ribbon in front of the head in a plurality of different positions so that different ink tracks face the head;

at least two electromagnets, respectively having plungers, and each one providing either a fully retracted or a fully protracted plunger position;

first lever means, including a one-arm lever pivoted at one end about a point fixed relative to the carriage, and being coupled to the plungers, to establish four different displacement positions of the free end of the one-arm lever, the positions depending upon the combination of states of energization and de-energization of the magnets, there being four such combination states accordingly; and second lever means connected to the one arm lever at a point between a pivot point of the one-arm lever and the free end thereof for translating the four displacement positions thereof into four different guide positions for establishing respectively said plurality of different positions of the ribbon guide.

2. The combination as in claim 1, the ribbon guide being pivoted on the head.

3. The combination as in claim 1, the first lever means including a second arm pivotally interconnecting said plungers, the one arm lever being pivotally connected to the second arm at a point being off center of the second arm.

4. The combination as in claim 3, the second lever means including an additional lever and a spring-biased rod coupled to the one arm and acting on the additional lever, the latter being connected to said guide.

5. The combination as in claim 4, wherein the guide is pivotally connected to the head and its weight acts against the spring bias.

* * * * *